US006712214B1

(12) United States Patent
Wintermute et al.

(10) Patent No.: US 6,712,214 B1
(45) Date of Patent: Mar. 30, 2004

(54) STACKABLE DISPLAY TRAY

(75) Inventors: William Wintermute, Phillipsburg, NJ (US); Jason Middleton, Flanders, NJ (US); Steve Cassin, Washington, NJ (US); Dave Hoffman, Elizabethtown, PA (US); Frank DeBrincat, Tobyhanna, PA (US); Cameron Lodi, Easton, PA (US)

(73) Assignee: Mars, Inc., McLean, VA (US)

( * ) Notice: Subject to any disclaimer, the term of this patent is extended or adjusted under 35 U.S.C. 154(b) by 0 days.

(21) Appl. No.: 09/540,168

(22) Filed: Mar. 31, 2000

(51) Int. Cl.[7] ..... B65D 01/22

(52) U.S. Cl. ..... 206/745; 206/509; 206/512; 229/199

(58) Field of Search ..... 206/745, 509, 206/512, 511; 229/199, 918, 919, 915

(56) References Cited

U.S. PATENT DOCUMENTS 3,929,273 A * 12/1975 Swanson ..... 206/562
4,053,100 A * 10/1977 Baptist ..... 206/512
4,245,773 A * 1/1981 Stollberg ..... 206/509
4,291,830 A * 9/1981 Sorensen ..... 229/143
4,304,353 A * 12/1981 Stollberg ..... 229/126
4,497,408 A * 2/1985 Jes ..... 206/509
4,537,344 A * 8/1985 Thomas ..... 229/169
5,335,844 A * 8/1994 Young ..... 229/122.26
5,390,847 A * 2/1995 Young ..... 229/122.21
5,487,505 A * 1/1996 Nilsson ..... 229/191
5,535,941 A * 7/1996 Garza ..... 229/191
5,593,087 A * 1/1997 Ross et al. ..... 229/199
5,690,272 A * 11/1997 England ..... 229/122.24

FOREIGN PATENT DOCUMENTS

| | | |
|---|---|---|
| EP | 0453015 | 10/1991 |
| EP | 0485032 | 5/1992 |
| WO | WO 98/25830 | 6/1998 |
| WO | WO 00/20286 | 4/2000 |

* cited by examiner

*Primary Examiner*—Paul T. Sewell
*Assistant Examiner*—Troy Arnold
(74) *Attorney, Agent, or Firm*—Fitzpatrick, Cella, Harper & Scinto

(57) ABSTRACT

A stackable display tray including a shell having a plurality of sides defined by an equal number of corners, a substantially closed bottom having bottom corners corresponding with the corners of the shell, and a top having top corners corresponding with the corners of said shell. The top includes at least two first openings each adjacent to an independent top corner, and the bottom includes at least two second openings each adjacent to an independent bottom corner. The display tray also includes a side panel member having at least two angular panels positioned within the shell adjacent at least two of the corners and including a tab projecting from the top of at least two of the angular panels. At least two of the first openings each receive the tab of one of the angular panels positioned within the shell and at least two of the second openings are each adapted to receive a tab of an angular panel of a side panel member which projects out from a top of an adjacent display tray positioned below the bottom.

13 Claims, 7 Drawing Sheets

STACKABLE DISPLAY TRAY

BACKGROUND OF THE INVENTION

1. Field of the Invention

The present invention relates to a display tray for displaying products, and more particularly to a novel stackable display tray for providing a wide stacking platform for corresponding interlocked trays stacked in a column.

2. Related Background Art

Display cases are used primarily for product merchandising in retail stores. In order for a manufacturer of consumer products to remain competitive in the marketplace, displays must have design flexibility for multi-location use within the store, so that they are visible to consumers at any location. This requires display trays having the following characteristics: (i) ease of stacking in single and multiple columns; (ii) maximum product visibility; and (iii) structural stability for extended periods of time in a variety of merchandising environments/locations.

SUMMARY OF THE INVENTION

The present invention addresses the above concerns and presents a new and novel stackable display system.

In one aspect of the present invention, a stackable display tray includes a shell having a plurality of sides defined by an equal number of corners (i.e., the number of corners is equal to the number of sides), a substantially closed bottom having bottom corners corresponding with the corners of the shell, and a top having top corners corresponding with the corners of said shell. The top includes at least two first openings each adjacent to an independent top corner, and the bottom includes at least two second openings each adjacent to an independent bottom corner. The display tray also includes a side panel member having at least two angular panels positioned within the shell. Each angular panel is adjacent a corner. At least two of the angular panels include a tab projecting from the top. At least two of the first openings each receive the tab of one of the angular panels positioned within the shell and at least two of the second openings are each adapted to receive a tab of an angular panel of a side panel member which projects out from a top of an adjacent display tray positioned below the bottom.

In yet another aspect of the present invention, a stackable display system includes a plurality of display trays, each having a shell and a side panel member as described in the previous aspect, stacked on top of one another.

In another aspect of the present invention, a side panel member for a shell of a display tray includes a first panel and at least two angular support panels integral with the first panel, each including a tab projecting from the top of the angular panel for insertion into a corresponding opening within the shell. The side panel member also includes a display panel integral with the first panel, where the display panel is visible in an opening in a side of the shell and the display panel may be removed to access an interior of the display tray.

The display panel may include printed information on one or both sides, so that if the display panel is folded down and over the side of the shell of the display tray to access the contents of the tray, product information is still available to the consumer. Such information is generally related to the type, amount, color, flavor, etc., of the product contained within the display tray.

The display panel may also be removable from the side panel member by providing a perforated portion along the fold line. The shell and side panel members of the display tray may be made from pre-cut panels that are folded into the respective shapes as described in the previous aspect.

DETAILED DESCRIPTION OF THE PREFERRED EMBODIMENT

Figure 1:
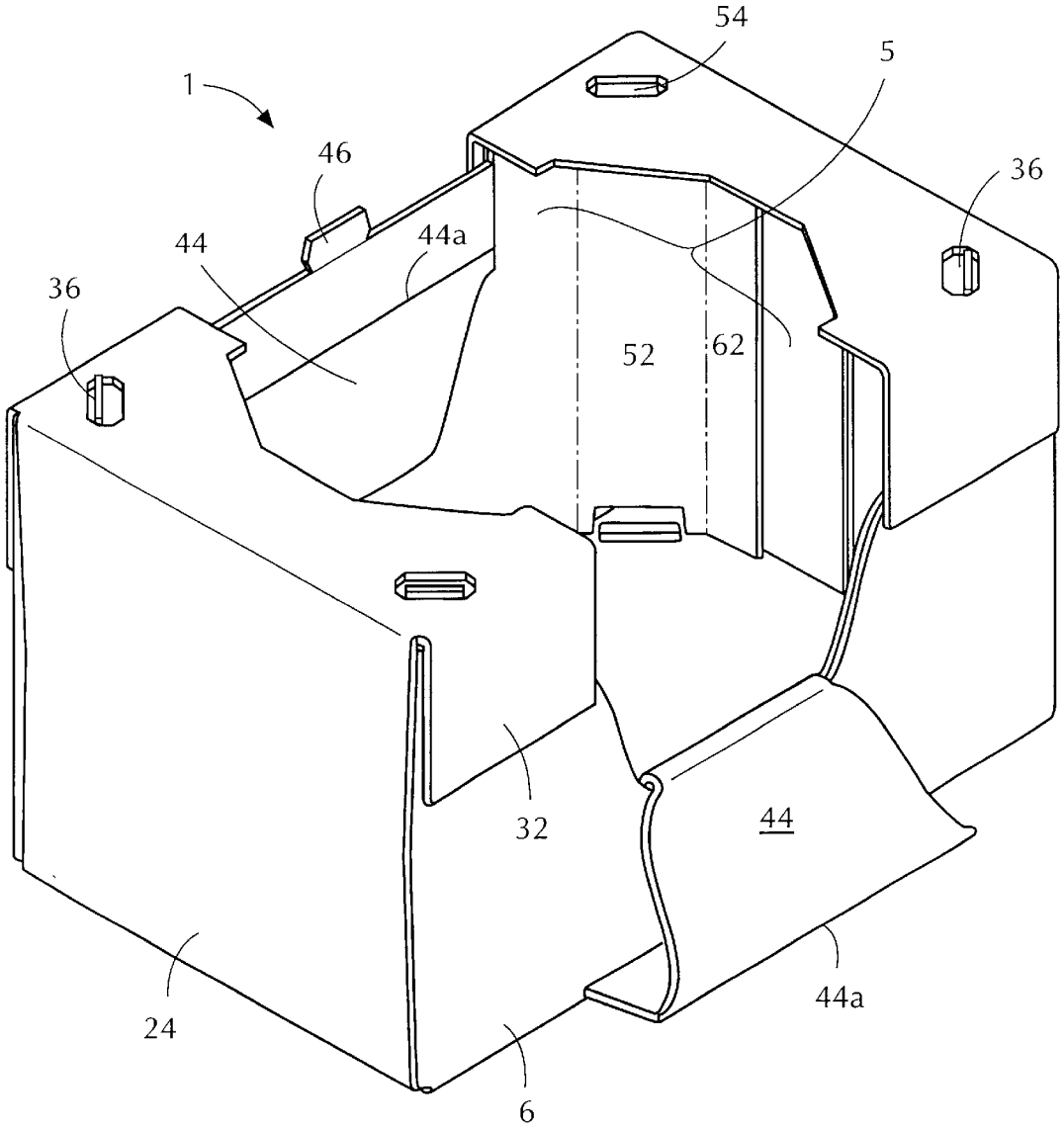
FIG. 1 is a perspective view of an assembled display tray according to the present invention.
Figure 3:
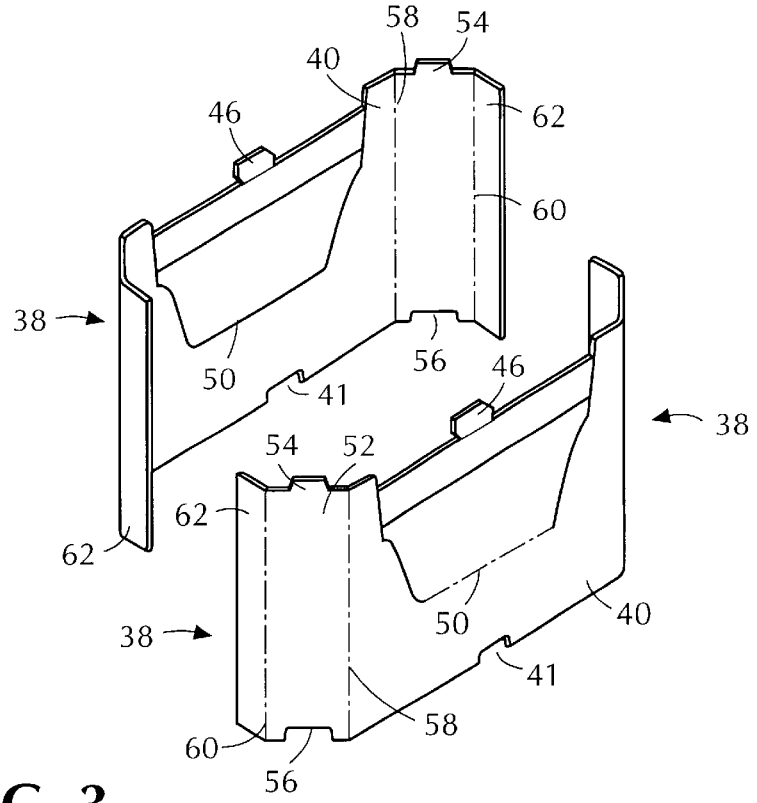
FIG. 3 is a schematic, perspective view of a side panel member for the stackable display tray according to the present invention.

The shell of the stackable display tray of the present invention must have at least three sides, but preferably is four sided and rectangular in shape. As used herein, rectangular means any shell having sides that meet at substantially right angles. It will be apparent that a three sided shell will be triangular. Other exemplary shapes that the shell of this invention may take include pentagons and hexagons.

The top of the shell must have at least two first openings or slots, with each first opening being adjacent to an independent top corner. Most preferably, the top will have a first opening adjacent each independent top corner, i.e., a triangular display tray would preferably have a top with three first openings and a rectangular display tray would preferably have a top with four first openings. The bottom of the display must have at least two second openings with each second opening being adjacent to an independent bottom corner. The bottom also preferably will have a second opening adjacent each independent bottom corner.

The display tray also includes one or more side panel members positioned within the shell. The side panel will include at least two angular panels. Each angular panel is positioned adjacent an independent corner. Projecting from the top of at least two of the angular panels is a tab. Each tab is received by an independent first opening in the top of the shell. Preferably, the display tray having a rectangular shape includes two side panels each having two angular panels with each angular panel having a tab that is received by one of four independent first openings.

It should be noted that at least two of the second openings of the bottom of the shell are adapted to each receive a tab of an angular panel of a side panel member projecting from the tops of an adjacent display tray. While this is preferably accomplished by positioning the second openings of the bottom in a manner corresponding, i.e., vertically aligned, to the first openings in the top, this is not always required. For example, a rectangular shell having four equivalent sides, i.e., a square shell, may have first openings with projecting tabs at two corners which are caddy corner to each other and second openings in the bottom of the shell at the other two corners of the square shell. Such a display tray would simply be rotated ninety degrees in order to stack the trays so that each second opening received a tab projecting from the top of the bottom box. It should also be noted that the number of second openings in the bottom of the shell must be equivalent to or greater than the number of tabs projecting from the top of a corresponding stackable display tray. Most preferably, second openings are equivalent to the number of tabs projecting from the stackable display tray.

FIGS. 1–9 illustrate the preferred embodiments of a rectangular stackable display tray 1, formed by assembling an outer shell 4 and at least one inner side panel 38 positioned within the shell. Each panel 38 helps provide structural stability when several display trays are stacked on top of one another.

Both components may be manufactured from corrugated paperboard components, or the like, produced with cutting dies and printing plates according to processes well know to those of ordinary skill in the art. With such processes, sheets of material are cut into flat panels which are folded and affixed together to form the shell and the side panels.

The shell 4 is formed by folding the respective die-cut panel in the following manner. Starting on a flat surface, panel sides 10 of first panels 6 are folded in toward the centers of panels 6 along fold 12 so that the first panels 6 may be folded up along fold 14 into what will be the interior of the tray.

While retaining the first panels 6 in an upright position (with front and rear side panels 10 being maintained in a folded condition on the interior of the shell), second panels 24 are folded in the direction of the interior along folds 22.

Before placing the panels in their final positions, an adhesive is applied to the outer surface of side panels 10, so that they may be adhered to the inside of second panels 24. It is also possible to place side panels 10 on the exterior of second panels 24. This alternative placement, however, results in an exterior seam and this is not preferable.

A variety of adhesives may be used which are sufficient for adhering paperboard or an equivalent material to itself. It is preferable, however, that a quick-setting adhesive be used since the folded portions of the shell are under stress, tending to unfold when placed in the folded position and released.

An example of such a quick setting adhesive is a heat sensitive adhesive, applied when the adhesive is in a melted condition. When adhering two surfaces together, melted adhesive is applied to the first surface, then the second surface is placed in immediate contact with the first surface. The melted adhesive quickly solidifies shortly after the two surfaces are brought together since the ambient temperature of the surfaces cool the adhesive almost immediately after joining. Preferably, the panels to be adhered together are held under compression for a period of time until the adhesive has set.

As one of ordinary skill in the art will appreciate, the panels may also be joined by including interlocking portions on the panels. For example, one surface may include a cut-out or slot for receiving a corresponding locking member from another surface to connect thereto. Moreover, additional panels may be included, which, when folded over, keep an enclosed panel secure.

Figure 2:
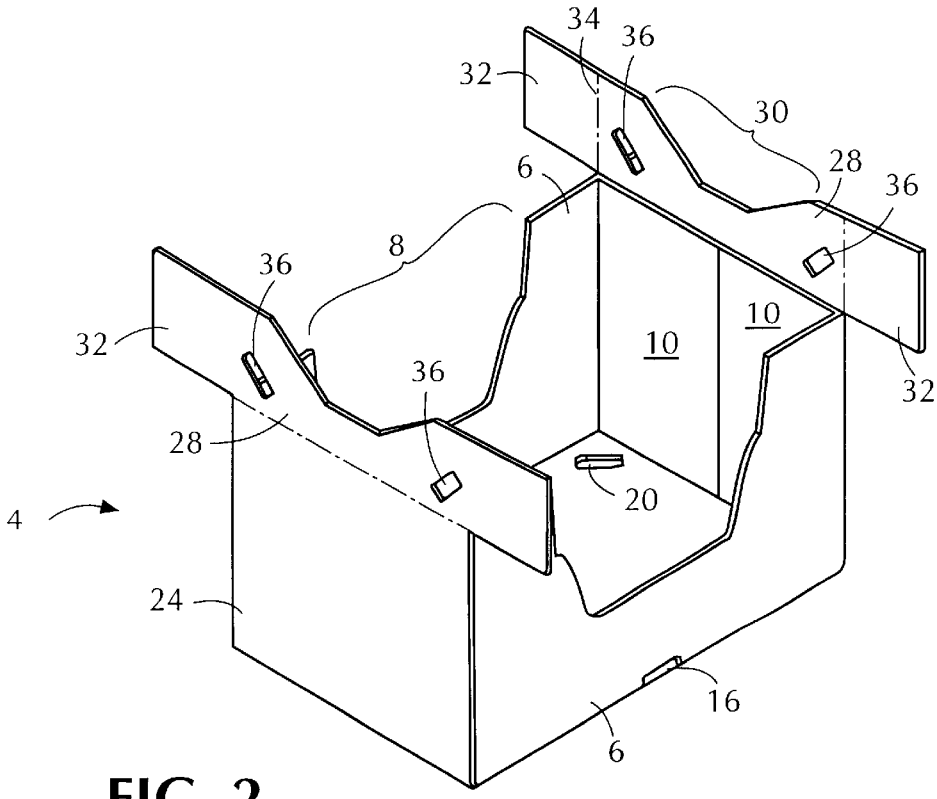
FIG. 2 is a schematic, perspective view of a shell for the stackable display tray according to the present invention.
Figure 4:
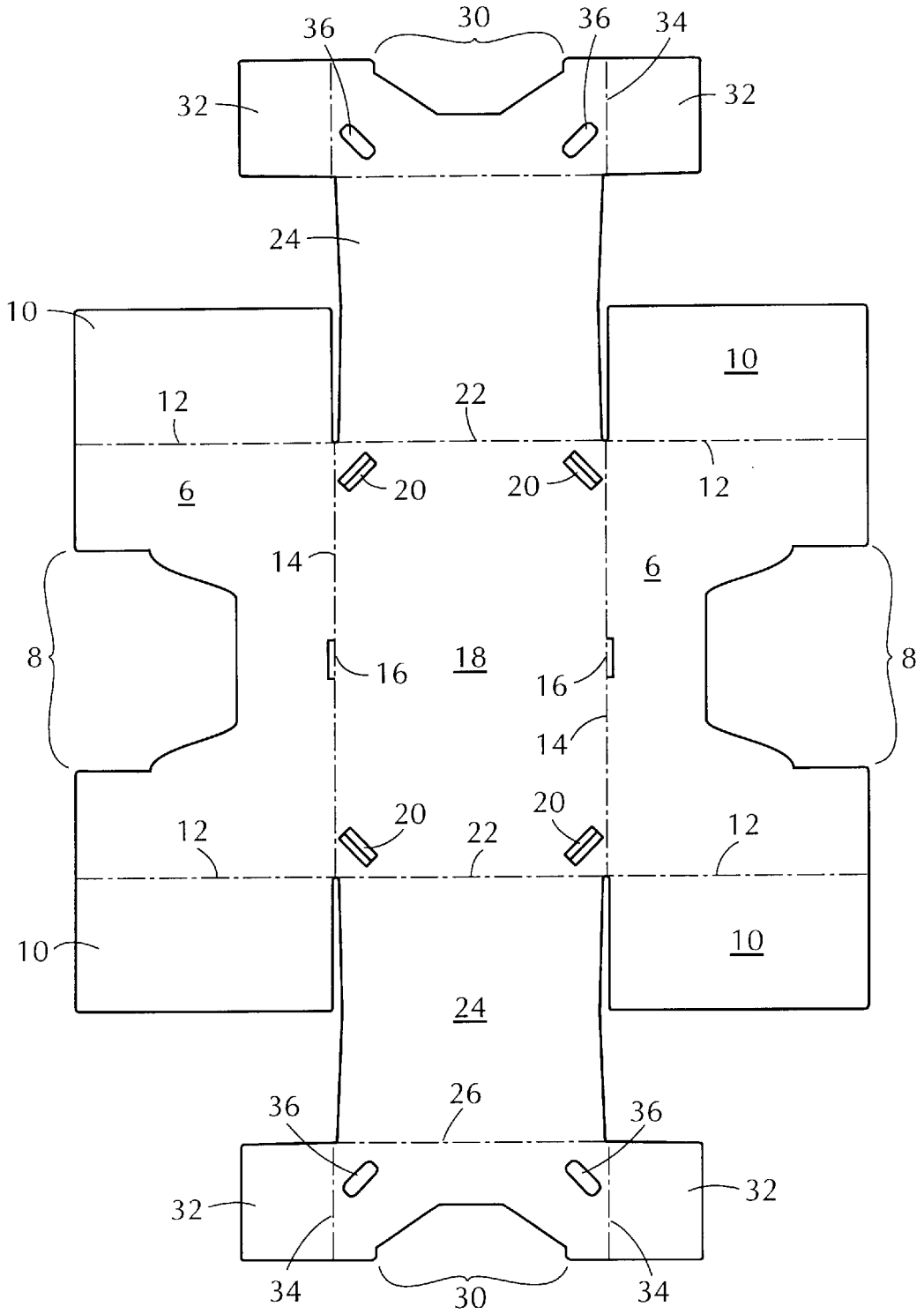
FIG. 4 is a schematic, top plan view of a flat panel cut-out of the shell of the stackable display tray according to the present invention.

The assembled shell includes a closed bottom and a top which can be either an open top 5, a partially closed top, or a substantially closed top. Openings 8 may be employed for displaying product, or if the top is partially or substantially closed it may include readily removable portions which may be pulled back and/or ripped off to expose product from the top. As shown in FIGS. 1 and 2, the top, in a preferred embodiment, includes a large center opening 5, as well as the opening portions 8 adjacent panels 28.

In a preferred embodiment of the present invention, a separate slip-off, corrugated cover may be provided that is slipped over a filled display tray having an open top, in order to keep dust and particles off the contents of the tray. Such a cover may have one or more sides integral with a side(s) of the shell. For example, with one side of the cover integral with a back side of the display tray, i.e. the hinged side, a consumer can lift the side of the cover opposite the hinged side, and fold the cover back along the backside of the tray, or torn off if the hinged side of the cover is removably attached (perforated) to the shell. Alternatively, a four-sided cover may be fitted over a corresponding four-sided tray, so that the cover can be simply lifted off to access the product.

Figure 5:
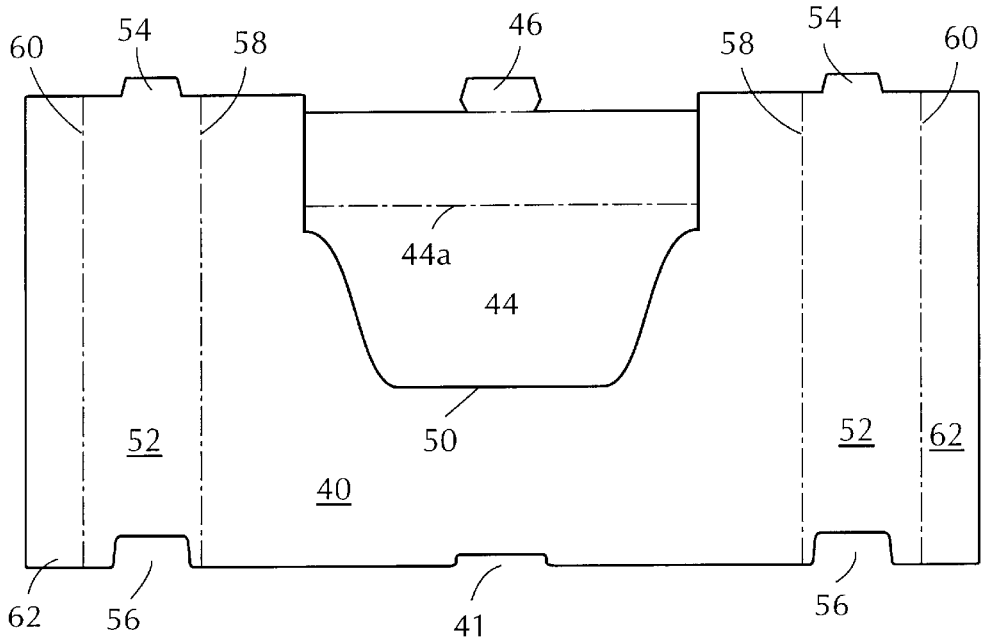
FIG. 5 is a schematic, top plan view of a flat panel cut-out of the side panel member of the stackable display tray according to the present invention including a display panel.
Figure 6:
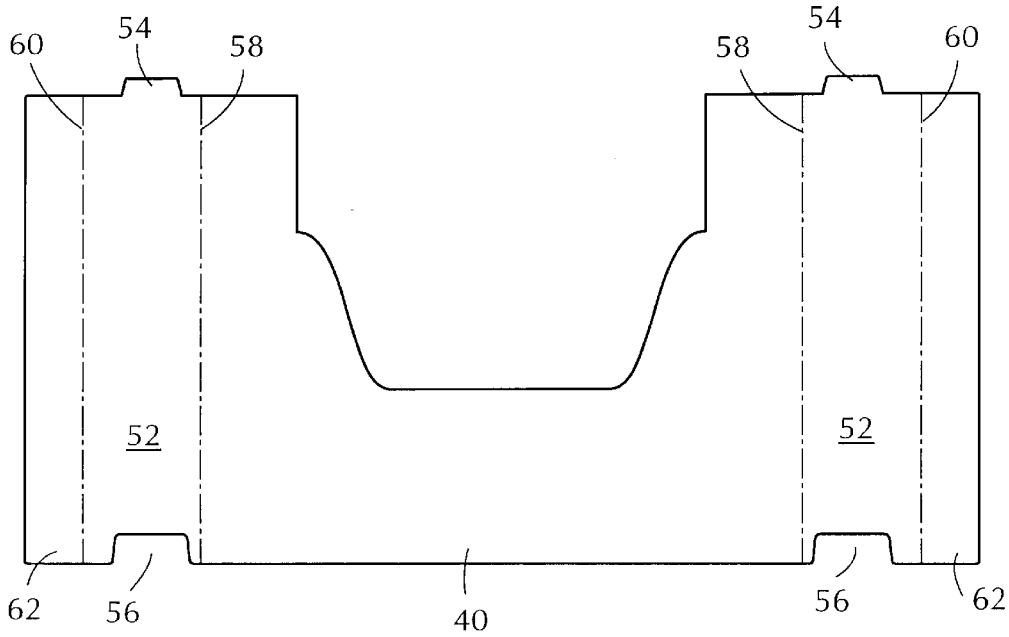
FIG. 6 is a schematic, top plan view of a flat panel cut-out of the side panel member of the stackable display tray according to the present invention without the display panel.
Figure 7:
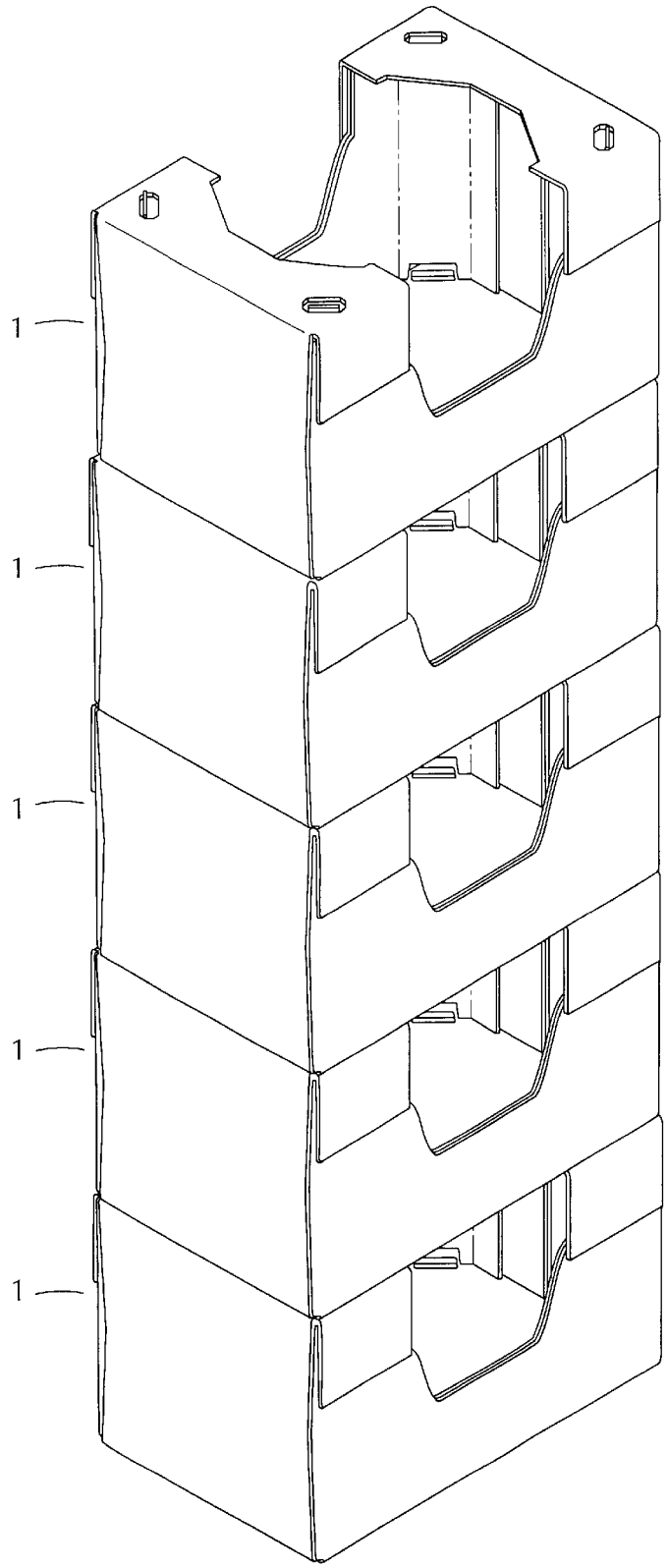
FIG. 7 is a perspective view of a single column of stacked display trays according to the present invention.

After the majority of the shell has been formed and the adhesive set, at least one, preferably two, side panel members 38 are positioned within the shell. As shown in FIG. 5, each side panel member is initially a flat panel having foldable structure including a first panel 40 having angular corner panels 52 positioned on either side. At the end of each corner panel are end panels 62, with folds 58 and 60 flanking the corner panel next to the first panel 40 and the end panel 62, respectively.

Each corner panel includes a top tab 54 and a bottom recess 56. Each tab 54 is received by an opening 36 positioned on panel 28, when top panels 28 are folded down around the sides of the box, preferably, after the display tray has been filled with product. Each tab 54 passes through the respective opening 36 and protrudes above the top surface of the display to be received by a bottom opening 20 in another display tray stacked on the existing tray. The interlocking of the tabs 54 in the respective openings substantially eliminate relative linear movement between adjacent display trays.

Each corner panel 52 of a side panel member is folded along a respective fold 58, so that it creates a first angle between about 30–60° with the first panel 40, and more preferably about 45°. End panels 62 are folded along fold 60 to from an angle of approximately 90° to the first panel 40. A second angle between the end panel 62 and the corner panel 52 varies depending upon the angle that exists between the corner panel 52 and the first panel 40, and is complimentary to the first angle—adding the first angle to the second angle yields approximately 90°.

The angular corner panel 52 may be individual panels, a pair (as illustrated and described herein), or even a single perimeter board folded to form all four angular panels. Moreover, one of ordinary skill in the art would also appreciate that the panels may be formed so that they may be placed outside the shell, surrounding each corner.

In a preferred embodiment, the side panel members may also be formed with an additional panel 44, which includes a fold 44*a*, formed substantially in the center as shown in the figures. Panel 44 is hinged to panel 40 along fold 50, and may include a tab 46 which is received in a corresponding slot 16 positioned on the bottom of the first panels 6 of the shell 4.

When the side panel members 38 are installed, the panel 44 is kept in the closed position to protect the contents of the display. When a consumer wishes to access the contents, the panel 44 may be folded over along fold 50 and tab 46 is inserted into slot 16. Fold 44*a* is provided to form a base portion of the panel when it is folded over the side of the shell. Alternatively, panel 44 may be shorter in height so that fold 44*a* is not required. Given that the panel 44 of the side panel is usually adjacent the first panel 6 of the shell 4, panel 44 may include an opening 41 corresponding in position and size to slot 16, so that tab 46 may also be received therein.

The solid panel 44 may also be used as a marketing display panel for displaying additional information about the product contained in the display, or for creating an ornamental design that adds aesthetic appeal to the display tray. This feature also enables the present invention to be used as a universal shell, with little or no product information printed thereon, for packaging with any product. Pertinent information regarding the display trays content may then be included on the solid panel 44. Thus, one would be able to tell what product is contained in the shell by looking at the printed matter on the panel 44.

Thus, one shell may be created with multiple side panel inserts for each designated product to go into the shell. Accordingly, multiple printed shells may be eliminated resulting in cost savings on printing and storage.

Such use of a marketing panel may be used on one or all sides of a perspective display tray. Furthermore, product information may be printed on both sides so that when the panel is folded down and over the bottom of the first panel 6 of the shell, product information can still be visible.

It will be appreciated that it is not necessary to use an adhesive to keep the side panel members 38 in position within the shell 4, although one may be used to insure positioning of the panel within the shell. An alternative or additional form of securing the positioning of the side panel members is to size them to frictionally fit within the shell. Specifically, the side panel members may be sized so that they are slightly larger than the distance between the inner surface of the folded over top panel 28, and the bottom panel 18 of the shell 4. The locking of tab 54 within an opening 36 also aids in the keeping the side panel members in place. Preferably, however, an adhesive is used as an added measure to secure the panels within the shell of the display tray.

After the side panel members are placed in their respective positions within the display tray, the display tray is filled with product. Thereafter, top panels 28 are folded over along fold 26, top side panels 32 are folded over fold 34 and then affixed by a quick-set adhesive to the sides of the first panels 6.

The display tray is complete after the adhesive used to affix the top side panels 32 to the first panels sets. The filled display trays can then be stacked in columns and palletized in multiple columns for shipment to consumer stores.

Multiple types of products may be packaged together. For example, when packaging candy, a different flavor may be in each display, so that a consumer may readily obtain any of the display candies.

Shell and display tray assembly may also be fully automated using box making equipment familiar to one of ordinary skill in the art. Such equipment automatically applied the adhesive all at once, forms the shell, inserts the side panel members, fills the display with product, and completes the packaging by folding and affixing final panels 28 and 32.

Figure 8:
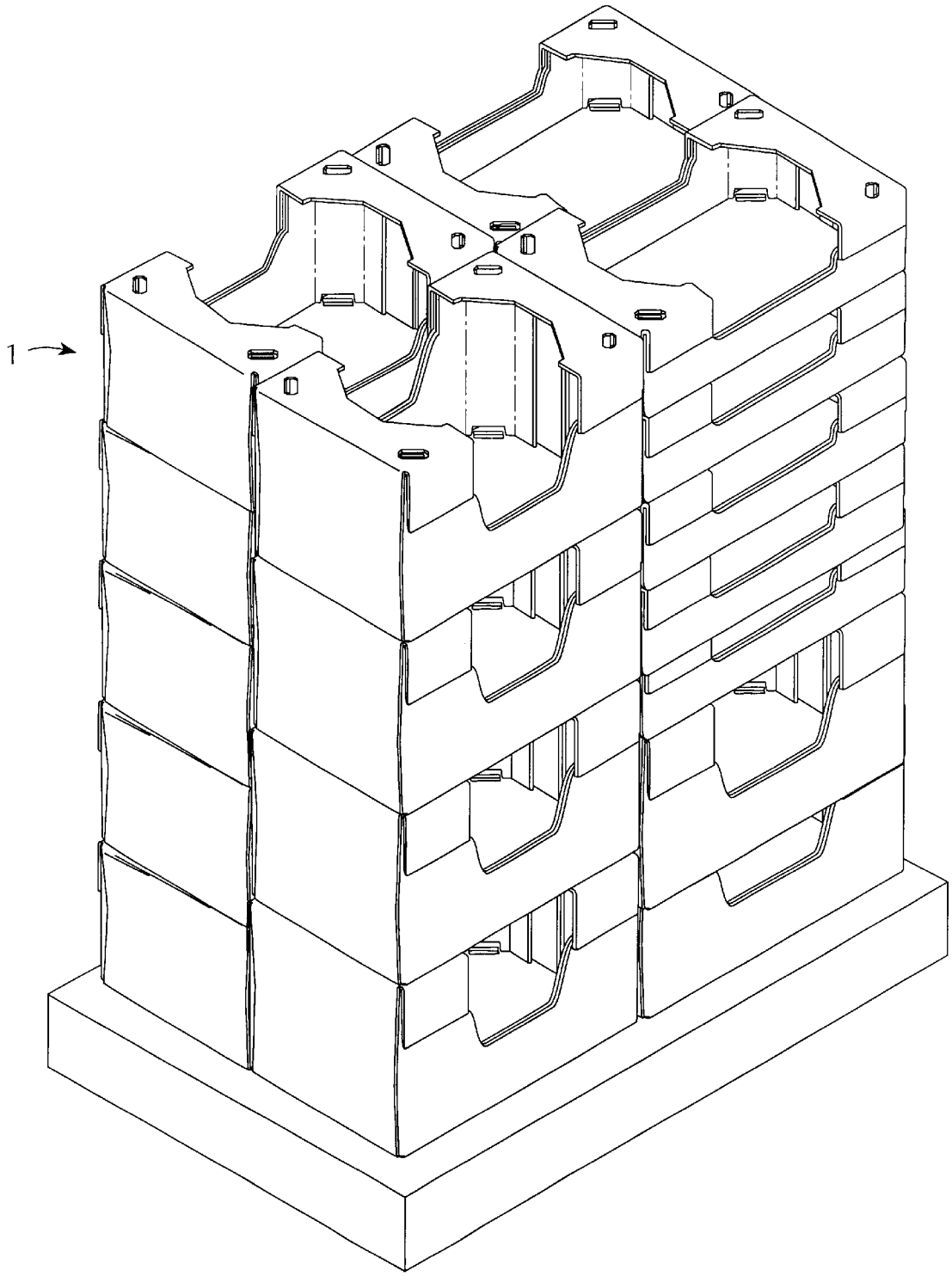
FIG. 8 is a perspective view a multiple column pallet of stacked display trays according to the present invention.

After packaging and final assembly of the display tray, the singular display trays may be stacked in single columns (see FIG. 7) or palletized in multiple columns (see FIG. 8). Each display tray of each column may also be covered with the slip on or integral cover for shipping. In addition or alternative to the slip-on cover, the display trays may be covered with a stretch or shrink wrap for shipping, particularly if the product is exposed via opening 5 at the top of the display tray or openings in the first panel 6 and panel 40. Stretch wrap over a column of display also helps to stabilize a pallet of trays during shipping.

Figure 9:
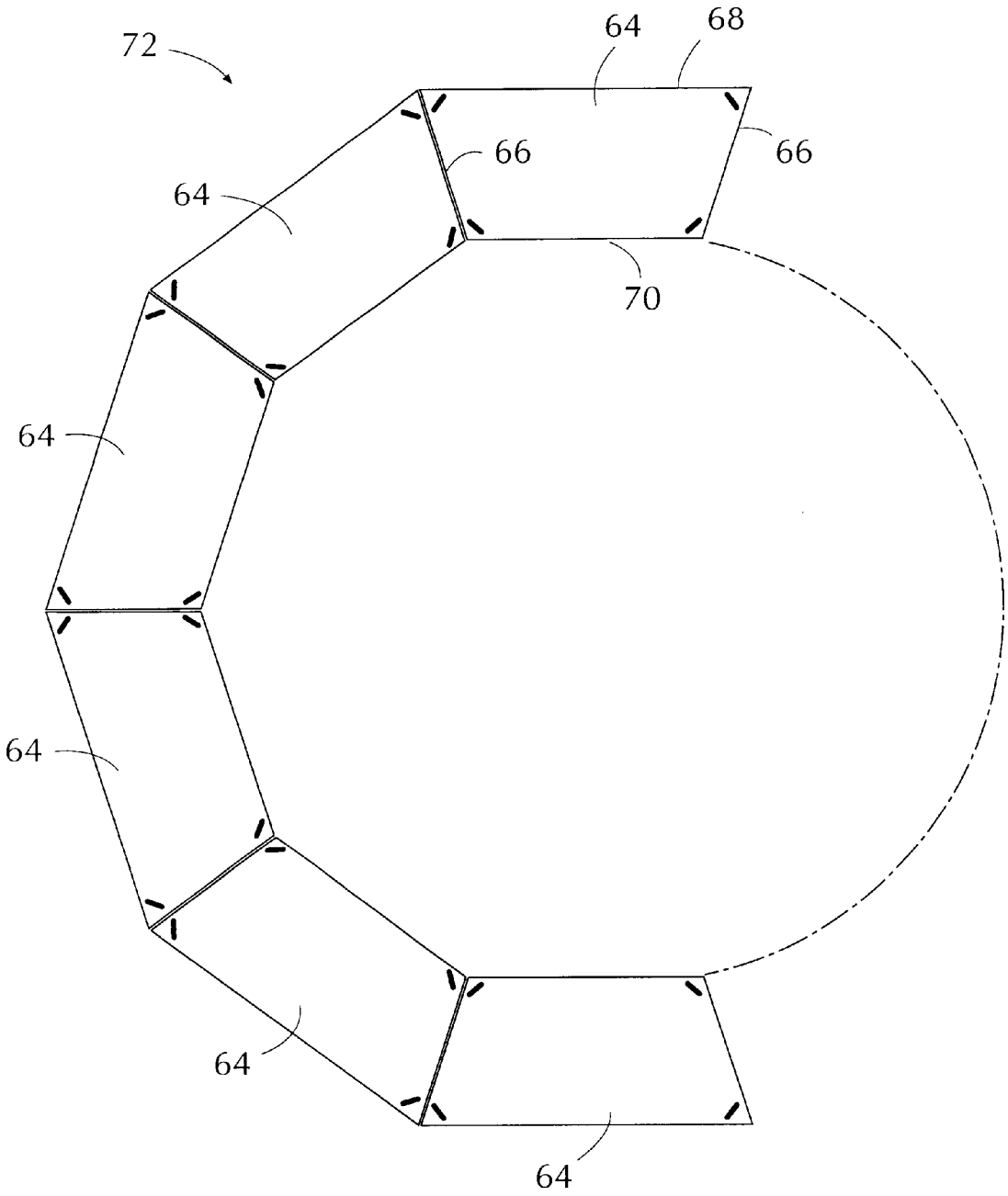
FIG. 9 is a schematic, top plan view of a circular grouped arrangement of display trays according to the present invention.

FIG. 9 illustrates another embodiment of the present invention, illustrating a stacked and grouped arrangement capable of being palletized. As shown, a four sided polygonal display tray 64 includes two opposite, equal length sides 66 connected to two opposite and unequal length sides 68 and 70. Such a display tray can be arranged adjacent to other similarly formed display trays to form a circular grouping 72. Such an arrangement can be palletized and shipped to the retailer to be displayed as is. Many other similar arrangements may be produced by changing the arrangement of the sides of the shell of the tray.

Other variations and modifications of this invention will be apparent to those skilled in this art after careful study of this application. This invention is not to be limited except as set forth in the following claims.

What is claimed is:

1. A stackable display tray comprising:

a shell having a plurality of sides defining an equal number of corners, a substantially closed bottom having bottom corners corresponding with said corners of said shell, and a top having top corners corresponding with said corners of said shell, said top having at least two first openings each adjacent to an independent top corner, and said bottom having a least two second openings each adjacent to an independent bottom corner; and a separate side panel member having at least two angular panels positioned within said shell adjacent at least two of said corners, said side panel member also including a tab projecting from the top of at least two of said angular panels, wherein at least two of said first openings each receive said tab of one of said angular panels positioned within said shell, and wherein at least two of said second openings are each positioned to receive a tab of an angular panel of a side panel member which projects out from a top of an adjacent display tray positioned below said bottom.

2. The stackable display tray according to claim 1, wherein said shell is rectangular and said top includes four first openings each adjacent to an independent top corner, said bottom having four second openings, each adjacent to an independent bottom corner and corresponding positionally to one of said first openings and another side panel member so that each of said first openings receives said tab of said angular panel.

3. The stackable display tray according to claim 2, wherein two of said at least two angular panels are integral with one another via a first panel including a display panel.

4. The stackable display tray according to claim 1, wherein a side of said shell is substantially open to permit access to contents of the tray.

5. The stackable display tray according to claim 1, wherein the top of the shell is substantially open to permit access to contents of the tray.

6. The stackable display tray according to claim 3, wherein the display panel integral with the side panel member can be viewed through a substantially open side of the shell.

7. A stackable display system comprising:

a plurality of display trays stacked on top of one another, each display tray comprising:

a shell having a plurality of sides defining an equal number of corners, a substantially closed bottom having bottom corners corresponding with said corners of said shell, and a top having top corners corresponding with said corners of said shell, said top having at least two first openings each adjacent to an independent top corner, and said bottom having at least two second openings each adjacent to an independent bottom corner; and a separate side panel member having at least two angular panels positioned within said shell adjacent at least two of said corners, said side panel member also including a tab projecting from the top of at least two of said angular panels, wherein at least two of said first openings each receive said tab of one of said angular panels positioned within said shell, and wherein at least two of said second openings are each positioned to receive a tab of an angular panel of a side panel member which projects out from a top of an adjacent display tray positioned below said bottom.

8. The stackable display system according to claim 7, wherein each said shell is rectangular and each said top includes four first openings each adjacent to an independent top corner, said bottom having four second openings, each adjacent to an independent bottom corner and corresponding positionally to one of said first openings and another side panel member so that each of said first openings receives said tab of said angular panel.

9. The stackable display system according to claim 7, further comprising a display panel integral with said side panel member which can be folded down over a substantially open side of said shell.

10. The stackable display system according to claim 7, each shell of each said display tray having two equal length sides integral with two unequal length sides.

11. The display tray of claim 1, wherein said side panel member has a notch in the bottom side of said side panel member to provide space for a tab on a side panel member of an adjacent stacked box, and at least one side panel member has a portion including a top edge of the panel removed to provide a substantially open side of the tray.

12. A display tray comprising:

a shell having a bottom, sides and openings to accommodate a side panel member;

the side panel member comprising a first panel;

at least two angular support panels integral with said first panel, each including a tab projecting from the top of said angular panel for insertion into a corresponding opening within said shell; and a display panel integral with said first panel, wherein said display panel is visible through an opening in a side of said shell, and wherein said display panel includes a top edge of the first panel which may be removed to access an interior of said display tray wherein said display panel includes a securing tab which is received in a corresponding opening in the bottom of said shell when said display panel is folded outwardly from said shell and folded over a side of said shell.

13. The side panel member according to claim 12, wherein said display panel is removable from said first panel.

* * * * *

UNITED STATES PATENT AND TRADEMARK OFFICE

CERTIFICATE OF CORRECTION

PATENT NO. : 6,712,214 B1
DATED : March 30, 2004
INVENTOR(S) : Williiam Wintermute et al.

It is certified that error appears in the above-identified patent and that said Letters Patent is hereby corrected as shown below:

Column 4,
Line 19, “torn” should read -- it can be torn --; and
Line 50, “complimentary” should read -- complementary --.

Signed and Sealed this

Tenth Day of August, 2004

JON W. DUDAS
*Acting Director of the United States Patent and Trademark Office*